United States Patent [19]

Breuer et al.

[11] 4,376,553

[45] Mar. 15, 1983

[54] FLOOR CUTTER BIT

[75] Inventors: Oswald Breuer, Dortmund-Hussen; Gerhard Merten, Lunen, both of Fed. Rep. of Germany

[73] Assignee: Gewerkschaft Eisenhutte Westfalia, Lunen, Fed. Rep. of Germany

[21] Appl. No.: 233,257

[22] Filed: Feb. 10, 1981

[30] Foreign Application Priority Data

Feb. 12, 1980 [DE] Fed. Rep. of Germany ..... 3005110

[51] Int. Cl.[3] ..... E21C 27/44

[52] U.S. Cl. ..... 299/34; 175/410; 299/79

[58] Field of Search ..... 175/410; 299/32, 34, 299/79

[56] References Cited

U.S. PATENT DOCUMENTS 3,793,960 2/1974 McKenry ..... 175/410 X 3,904,427 9/1975 Ostrop ..... 175/410 X

*Primary Examiner*—Ernest R. Purser

*Assistant Examiner*—Joseph Falk

*Attorney, Agent, or Firm*—Sughrue, Mion, Zinn, Macpeak and Seas

[57] ABSTRACT

A floor cutter bit for a coal plough has a cutter body which supports a floor cutter plate and a coal-face cutter plate. The two cutter plates are made of hard metal, and have respective cutting edges. The cutter plates are soldered into respective apertures in the cutter body. The cutting edge of the floor cutter plate extends the entire length of the floor cutter plate, and the floor cutter plate extends over the entire width of the cutter body. The base of the coal-face cutter plate adjoins the upper side of the floor cutter plate thereby defining an L-shaped cutter plate configuration. The depth of the floor cutter plate, at least in the region where the two cutter plates meets, is greater than about 15 millimeters.

9 Claims, 4 Drawing Figures

FLOOR CUTTER BIT

BACKGROUND OF THE INVENTION

This invention relates to a floor cutter bit for a mineral winning machine, and in particular to a floor cutter bit for a coal plough.

A coal plough floor cutter bit typically has cutting edges formed respectively on a pair of cutter plates, which are made of hard, wear-resistant metal, and which are positioned against one another to form an L-shape. One of the cutter plates (the floor cutter plate) is generally horizontal and positioned at the base of the body of the floor cutter bit; and the other cutter plate (the coal-face cutter plate) extends upwardly relative to the floor cutter plate. The two cutter plates are soldered into apertures in the body of the floor cutter bit. The cutting edge of the floor cutter plate extends obliquely upwards in the direction towards the coal face to be won. This configuration of the floor cutter plate results in the floor cutter bit cutting out a furrow in the floor of a mine working, which furrow also has a floor which slopes upwardly towards the coal-face. These sloping furrow floors facilitate the advance of the conveyor along which the coal plough is reciprocated to win the coal. This is because the leading edge of the conveyor (or of the plough guide attached thereto) engages within the furrow; and, because of the upward slope of the furrow, is subjected to only slight resistance during conveyor advance. Unfortunately, because of its upwardly-inclined cutting edge, the entire length of the floor cutter plate participates in the winning work, so that the floor cutter plate is heavily loaded, particularly where the floor cutter bit cuts into rock in the floor of the mine working (which is unavoidable in most mining operations). (see DE-Gm 75 06653).

This known type of floor cutter bit thus has a rather short working life because it wears quickly. Moreover, because it is heavily loaded, it tends to break out from the body of the floor cutter bit. This is attributable not only to the fact that the floor cutter plate has an inadequate support area, but also because of the considerable wear of the underneath side of the floor cutter bit close behind the floor cutting edge. This wearing process occurs not only during the working movement of the floor cutter bit, but also during the return movement when the cutting does not occur. This wear during the return movement is particularly troublesome when the pivotal movement of the floor cutter bit, into, and out of, its working position is not positively controlled.

With the known type of floor cutter bit, the area of the underneath surface of the bit which is worn reaches as far as the rear soldered joint holding the floor cutter plate within the body of the floor cutter bit. As solder is much softer than the hard metal of the floor cutter plate, this soldered joint obviously wears much quicker than the floor cutter plate. Eventually, this loosens the fixing of the floor cutter plate; and, in an extreme case, the floor cutter plate may even drop out of its aperture. This effect is known as "washing-out".

Washing-out also affects the coal-face cutter plate, but not to the same extent, as the coal-face cutter plate cuts mainly coal and not hard rock. However, as the coal-face cutter plate does extend to the base of the floor cutter bit, at least the lowest portion thereof can engage rock in the floor of a mine working, so a certain degree of washing-out can occur, at least in this lower region of the coal-face cutter plate.

Another disadvantage of the known type of floor cutter bit is that a hard metal pin has to be provided between the floor cutter plate and the coal-face cutter plate, and this leads to high production costs.

The aim of the invention is to provide a floor cutter bit which does not suffer from these disadvantages.

SUMMARY OF THE INVENTION

The present invention provides a floor cutter bit for a coal plough, the floor having a body, a floor cutter plate and a coal-face cutter plate, each of the cutter plates having a respective cutting edge, and each of the cutter plates being mounted within a respective aperture in the body, wherein the cutting edge of the floor cutter plate extends the entire length of the floor cutter plate, the floor cutter plate extends over the entire width of the body, and the base of the coal-face cutter plate adjoins the upper side of the floor cutter plate thereby defining an L-shaped cutter plate configuration.

With such a floor cutter bit, the cutter plates are embedded in their apertures in dependence upon the load conditions. Moreover, the cutter plates are supported not only within the body, but also against one another. Thus, as the floor cutter plate engages beneath the coal-face cutter plate, in the region of the leading edge of the cutter bit, the two cutter plates are well supported. Here, the two cutter plates and the body form a composite structure which does not require a hard metal pin to hold the cutter plates in position; and in which the stresses, occurring due to the different coefficients of expansion of the cutter plates and the body, are relatively harmless.

Preferably, the depth of the floor cutter plate, at least in the region where the two cutter plates meet, is greater than 15 millimeters.

The relative greater depth of the floor cutter plate (when compared with known floor cutter bits) results in a firmer connection between the floor cutter plate and its aperture in the body. This is because the cutting pressure forces the floor cutter plate into its aperture. Moreover, the depth of the floor cutter plate is such as to position its rear soldered joint beyond the area of frictional wear, and so washing-out is not a problem. Thus, the frictional wear of the floor cutter bit resulting from contact with the floor of the mine working occurs substantially entirely on the base of the hard metal of the floor cutter plate.

Advantageously, the depth of the floor cutter is greater than its height. This leads to a significant reduction in production costs, since it is possible to save a considerable quantity of hard metal. Another advantage of the relatively low height of the floor cutter plate, is that stresses, which occur due to differential coefficients of heat expansion, are reduced.

Conveniently, the surface of the floor cutter bit which, in use, faces the coal face is constituted by two rake faces, each of the rake faces being angled away from the coal face, and the two rake faces meeting along a line. Preferably, said line extends substantially at right-angles to the line bisecting the angle included by the two cutting edges. These rake faces assist with the flow away of the stripped-out or won coal. Advantageously, said line passes through the region in which the two cutter plates meet to form an internal corner. This configuration is advantageous because the pressure of the won coal is distributed to the two cutter plates in approximately the same ratio as the loading pressures applied to these plates.

Where the floor cutter bit has a considerable width, the floor cutter plate may be constituted by two floor cutter plate sections. Advantageously, the floor cutter plate section which adjoins the coal-face cutter plate has a length which is at least twice as great as the width of the coal-face cutter plate. This configuration guarantees a firm embedding of said floor cutter plate section, which is heavily loaded in use.

BRIEF DESCRIPTION OF THE DRAWINGS

One form of floor cutter bit constructed in accordance with the invention will now be described, by way of example, with reference to the accompanying drawings, in which.

DESCRIPTION OF PREFERRED EMBODIMENT

Figure 1:
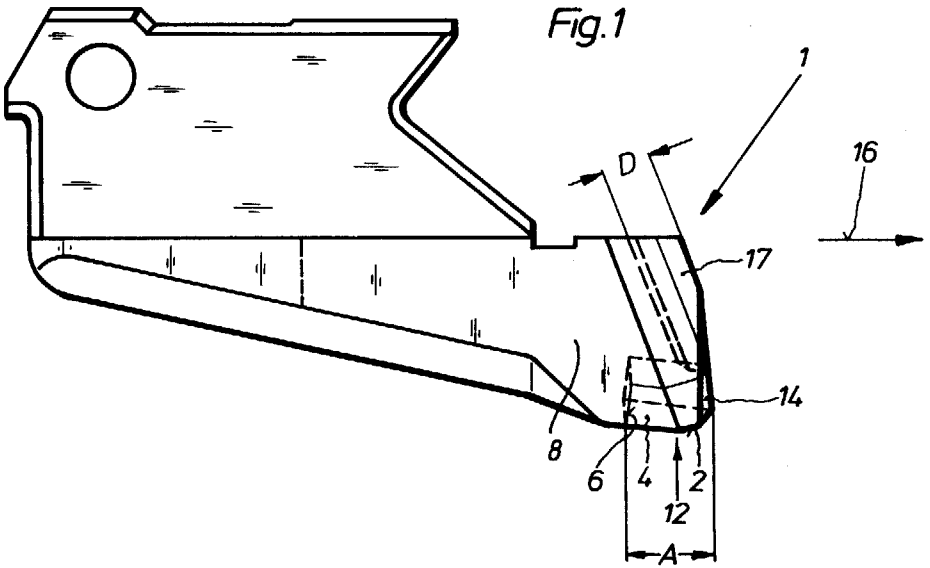
FIG. 1 is a side elevation of the floor cutter bit.

Referring to the drawings, the floor cutter bit 1 is provided with a floor cutting edge 2 and a coal-face cutting edge 3. The floor cutting edge 2 is formed on a floor cutter plate 4, and the coal-face cutter edge 3 is formed on a coal-face cutter plate 5. The plates 4 and 5 are made of hard, wear-resistant metal, and are soldered into apertures 6 and 7 respectively formed in a cutter body 8. The floor cutter plate 4 extends over the entire width L of the floor cutter bit 1, and the cutting edge 2 extends the entire length of the cutter plate 4. The coal-face cutter plate 5 rests against the upper surface of the floor cutter plate 4, so that the two plates define the shape of an "L", and the cutting edges 2 and 3 define an included angle W which is slightly greater than 90°. The cutting edges 2 and 3 meet at a rounded-off corner 9.

The depth A of the floor cutter plate 4, at least in the region of the corner 9, is about 15 millimeters; and its height B is about 10 millimeters. Thus, the depth of the cutter plate 4 is greater than its height. On the other hand, the width C and the depth D of the coal-face cutter plate 5 are substantially the same.

Figure 3:
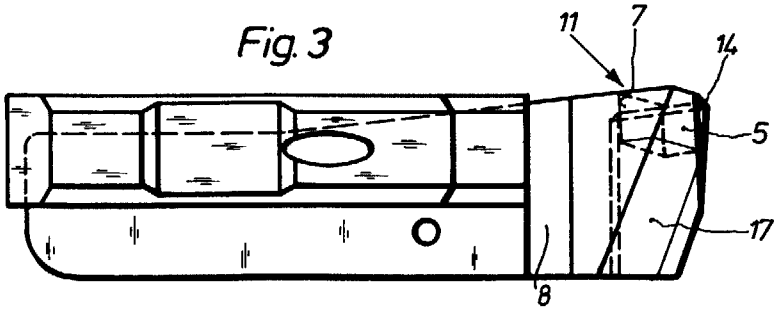
FIG. 3 is a plan view of the floor cutter bit.
Figure 2:
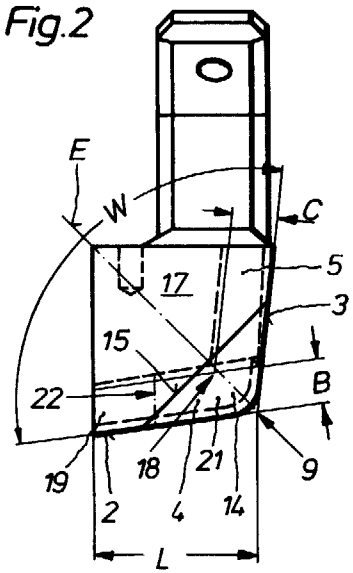
FIG. 2 is an end elevation of the floor cutter bit.
Figure 4:
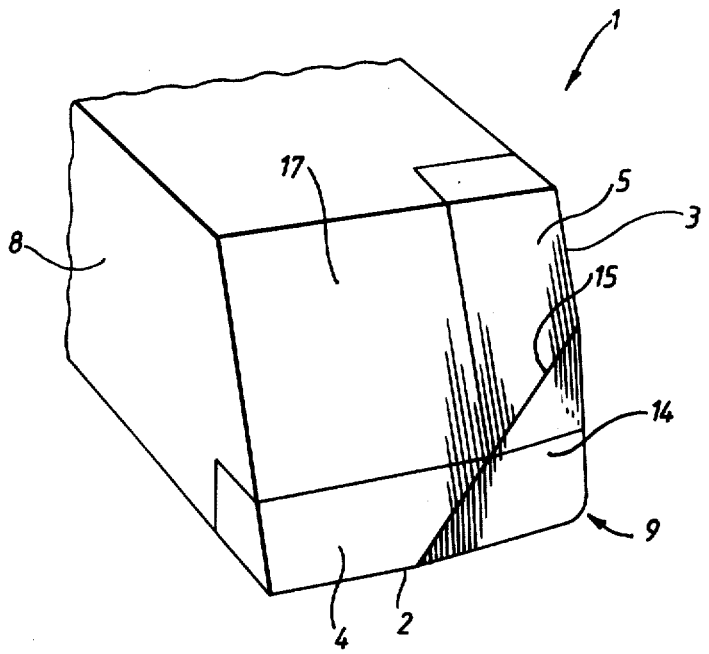
FIG. 4 is a schematic perspective view of the floor cutter bit.

As is usual with floor cutter bits, the floor cutter bit has its leading surface 11 (see FIG. 3) angled away from a vertical plane perpendicular to the face being won. This helps with the flow of the stripped-out or won coal. Similarly, the base surface 12 of the floor cutter bit 1 is angled relative to a horizontal plane perpendicular to the face. This again helps with the flow of won coal, and helps to prevent pieces of won coal jamming between the floor of the working and the base of the floor cutter bit 1. The front surface (that is to say the surface presented to the coal face) of the floor cutter bit 1 is provided with two rake faces 14 and 17. The rake faces 14 and 17 are angled away from the coal face, and away from one another about an apex line 15. The rake face 17 has a greater angle of inclination than the rake face 14, that is to say the rake face 17 makes a larger angle with the coal face than does the rake face 14. The apex line 15 extends substantially at right-angles to the line E which bisects the angle W, and in the opposite direction to that of the arrow 16 (see FIG. 1) which represents the direction of coal-face advance. The line E passes through, or adjacent to, the corner 18 formed by the cutter plates 4 and 5.

Where the floor cutter plate 4 has a considerable length L (for example, the length L can be 70 millimeters or more), it is advantageous to constitute the floor cutter plate by two sections. Thus, FIG. 2 shows the floor cutter plate 4 constituted by two sections 19 and 21. The sections 19 and 21 meet at a plane 22 which extends at right-angles to the coal face. In order to secure the floor plate section 21, which forms the corner 9, it is important that this section has a length which is at least twice the width C of the coal-face cutter plate 5.

The floor cutter bit 1 described above has the advantage that the two cutter plates 4 and 5 are supported not only within the body 8, but also against one another. In particular, the coal-face cutter plate 5 is supported o the floor cutter plate 4. Not only does this mean that a hard metal pin is not needed to hold the cutter plates 4 and 5 in position, but it also means that any stresses resulting from differential heat expansion are relatively harmless. Moreover, by supporting the coal-face cutter plate 5 on the floor cutter plate 4 the soldered joint holding the cutter plate 5 in position does not engage the floor of the mine working, so that washing-out of this joint does not occur. Similarly, by making the depth of the floor cutter plate 4 about 15 millimeters, the rear soldered joint holding the cutter plate 4 in position is beyond the area of frictional wear, so that washing-out of the floor cutter plate is also avoided. The increased depth of the floor cutter plate 4 (as compared with that of known floor cutter bits) also results in an increased support area for this cutter plate.

We claim:

1. A floor cutter bit for a coal plough, comprising: a body member (8), a floor cutter plate (4) and a single coal-face cutter plate (5), each of the cutter plates having a respective cutting edge (2,3), and each of the cutter plates being mounted within a respective aperture (6,7) in the body member, the cutting edge of the floor cutter plate extending the entire length of the floor cutter plate, the floor cutter plate extending over the entire width of the body member, and a base of the coal-face cutter plate adjoining an upper side of the floor cutter plate on a side thereof in a direction of lateral advance in use to define therewith an L-shaped cutter plate configuration.

2. A floor cutter bit for a coal plough, the floor cutter bit having a body, a floor cutter plate and a coal-face cutter plate, each of the cutter plates having a respective cutting edge, and each of the cutter plates being mounted within a respective aperture in the body, wherein the cutting edge of the floor cutter plate extends the entire length of the floor cutter plate, the floor cutter plate extends over the entire width of the body, a base of the coal-face cutter plate adjoins an upper side of the floor cutter plate thereby defining an L-shaped cutter plate configuration, and that surface of the floor cutter bit which faces the coal-face is constituted by two rake faces, each of the rake faces being angled away from the coal face, and the two rake faces meeting along a line.

3. A floor cutter bit according to claims 1 or 2, wherein each of the cutter plates is soldered into its respective aperture, and wherein the depth of the floor cutter plate, at least in the region where the two cutter plates meet, is greater than 15 millimeters.

4. A floor cutter bit according to claims 1 or 2, wherein the depth of the floor cutter is greater than its height.

5. A floor cutter bit according to claim 1, wherein that surface of the floor cutter bit which faces the coal face is constituted by two rake faces, each of the rake faces being angled away from the coal face, and the two rake faces meeting along a line.

6. A floor cutter bit according to claims 5 or 2, wherein said line passes through the region in which the two cutter plates meet to form an internal corner.

7. A floor cutter bit according to claims 5 or 2, wherein said line extends substantially at right-angles to the line bisecting the angle included by the two cutting edges.

8. A floor cutter bit according to claims 1 or 2, wherein the floor cutter plate is constituted by two floor cutter plate sections.

9. A floor cutter bit according to claim 8, wherein the floor cutter plate section which adjoins the coal-face cutter plate has a length which is at least twice as great as the width of the coal-face cutter plate.

* * * * *